US005630631A

United States Patent [19]

Iwamoto et al.

[11] Patent Number: 5,630,631

[45] Date of Patent: May 20, 1997

[54] DOOR LOCKING APPARATUS FOR DISPENSER

[75] Inventors: Shozo Iwamoto; Tetsuya Miyao; Kosaku Ito, all of Mie, Japan

[73] Assignee: Fuji Electric Co., Ltd., Kawasaki, Japan

[21] Appl. No.: 617,082

[22] Filed: Mar. 18, 1996

Related U.S. Application Data

[62] Division of Ser. No. 383,487, Feb. 3, 1995, Pat. No. 5,575, 515.

[30] Foreign Application Priority Data

Feb. 10, 1994 [JP] Japan ..... 6-015621

[51] Int. Cl.[6] ..... E05C 1/08

[52] U.S. Cl. ..... 292/156; 292/162; 292/150; 292/DIG. 25

[58] Field of Search ..... 292/156, 157, 292/162, 183, DIG. 25, 150

[56] References Cited

U.S. PATENT DOCUMENTS

| | | | |
|---|---|---|---|
| 497,581 | 5/1893 | Kirby | 292/156 X |
| 913,834 | 3/1909 | Martin | 292/156 |
| 2,153,088 | 4/1939 | Knell | 292/162 X |
| 3,950,018 | 4/1976 | Pickering | 292/144 |

FOREIGN PATENT DOCUMENTS

| | | | |
|---|---|---|---|
| 92208 | 4/1923 | Austria | 292/183 |

*Primary Examiner*—Rodney M. Lindsey
*Attorney, Agent, or Firm*—Kanesaka & Takeuchi

[57] ABSTRACT

A door locking apparatus of the invention is suitable for locking and unlocking a door of a dispenser and a case thereof. The apparatus includes a door lock mechanism situated between the door and the case for latching the door at a locked position, a solenoid mounted inside the door for releasing the door lock mechanism, a receiver mounted inside the door and connected to the solenoid, and a transmitter for sending an ID signal from an outside of the door to the receiver. When the receiver receives the ID signal from the transmitter, the solenoid actuates to release the door lock mechanism. Since the door lock mechanism is not seen from the outside of the door, the lock is protected from bad mischief and burglary.

5 Claims, 4 Drawing Sheets

DOOR LOCKING APPARATUS FOR DISPENSER

This is a division of application Ser. No. 08/383,487, filed Feb. 3, 1995, now U.S. Pat. No. 5,575,515.

BACKGROUND OF THE INVENTION AND RELATED ART STATEMENT

The present invention relates to a door locking apparatus for a dispenser.

The door locking apparatus for a dispenser according to the prior art uses a manual lock released by a passkey or master key, though there are differences in the locking mechanisms. The lock is usually disposed on the front of the door at the height at which the key is easily handled in considering the convenience of handling of the key as well as opening and closing of the door.

The door locking apparatus according to the prior art does not always effectively prevent bad mischief and burglary. Most of the losses of money and goods from the dispensers relate to the lock. Burglars very often steal money and goods at night when the traffic is few by opening the door of the dispenser with a dummy key or by breaking the lock with a tool, such as a drill, hammer and etc. It has been pointed out that the lock of the prior art is exposed to the easily recognizable position at the front door, so that the lock can be easily broken by the tool, such as a drill, hammer and etc.

Therefore, it is expected that most of the above described losses of money and goods from the dispenser may be prevented by eliminating the lock exposed to the front of the door and instead disposing releasing means for releasing the lock mechanism, or by disposing the lock at the position which is hardly recognized from the front of the door and hardly reached by a tool, such as a drill.

In view of the foregoing, an object of the present invention is to provide a door locking apparatus which is highly effective for protecting the dispensers from a bad mischief and burglary of money and goods.

SUMMARY OF THE INVENTION

The object of the present invention is achieved by a first aspect of a door locking apparatus for locking and unlocking a door and a case of a dispenser, which comprises a door lock mechanism for latching the door at a locked position; a solenoid mounted inside the door for releasing the door lock mechanism; a transmitter for sending an ID signal from the outside of the door to remotely control the solenoid; and a receiver mounted inside the door.

The object of the present invention is also achieved by a second aspect of a door locking apparatus for locking and unlocking a door and a case of a dispenser, which comprises a door lock mechanism for latching the door at a locked position; and a manual lock disposed in the bottom of the door and linked with the door lock mechanism through a wire for manually unlocking the door.

The object of the present invention is also achieved by a third aspect of a door locking apparatus for locking and unlocking a door and a case of a dispenser, which comprises a door lock mechanism for latching the door at a locked position; a solenoid mounted inside the door for releasing the door lock mechanism; a transmitter for sending an ID signal from the outside of the door and remotely controlling the solenoid; a receiver mounted inside the door; and a manual lock disposed in the bottom of the door and linked with the door lock mechanism through a wire for unlocking the door.

In the door locking apparatus as stated above, the door lock mechanism is preferably formed of an auto-lock mechanism for automatically latching the door when closed.

In the door locking apparatus comprised of a door lock mechanism for latching the door at a locked position; a solenoid mounted inside the door for releasing the door lock mechanism; a transmitter for sending an ID signal from the outside of the door for remotely controlling the solenoid; and a receiver mounted inside the door, a manual type mechanical lock operated by a master key does not exist on the front of the door, and all the mechanisms including the door lock mechanism are hidden behind the door while the installing position of the door lock mechanism can not be recognized. Therefore, it is possible to protect the dispenser from bad mischief and burglary of money and goods relative to lock. Also, by using the lock release mechanism controlled remotely, a security higher than the conventional manual lock is obtained.

In the door locking apparatus comprised of a door lock mechanism for latching the door at a locked position; and a manual lock disposed in the bottom of the door and linked with the door lock mechanism through a wire for manually unlocking the door, since the manual lock is located at the lower side of the door, it is hardly recognized from the outside of the dispenser. Also, since the installation position of the lock is near the ground and the floor, the tools, such as a drill, hammer and etc. are hardly used through the narrow space. Therefore, the door locking apparatus has high security for bad mischief.

In the door locking apparatus comprised of a door lock mechanism for latching the door at a locked position; a solenoid mounted inside the door for releasing the door lock mechanism; a transmitter for sending an ID signal from the outside of the door for remotely controlling the solenoid; a receiver mounted inside the door; and a manual lock disposed in the bottom of the door and linked with the door lock mechanism through a wire, the door lock mechanism includes the manual lock operated by a master key as auxiliary releasing means at the lower side of the door, in addition to the remote control type door unlocking mechanism. In an emergency situation, such as electric power failure and failure of the remote control means, the door can be opened by the master key. Therefore, it retains high maintenance ability and service ability.

BRIEF DESCRIPTION OF THE DRAWINGS

FIG. 1(*b*) is a block diagram of the door locking apparatus;

FIG. 2(*b*) is a plan view of the door lock mechanism in a locked condition;

FIG. 4(*b*) is a side view illustrating a latched door lock mechanism; and

FIG. 4(*c*) a side view illustrating the released door lock mechanism.

DETAILED DESCRIPTION OF PREFERRED EMBODIMENTS

Now the present invention will be described in detail hereinafter with reference to the accompanied drawings which illustrate the preferred embodiments of the present invention.

Figure 1A:
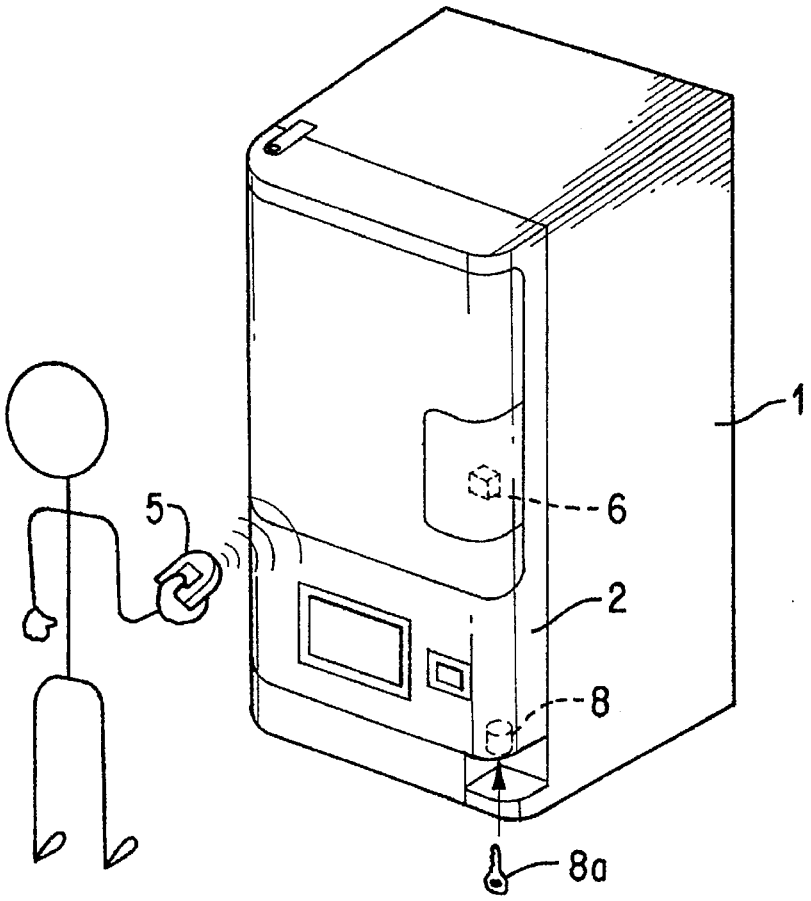
FIG. 1(*a*) is a schematic view of a dispenser having a first embodiment of a door locking apparatus of the present invention.
Figure 1B:
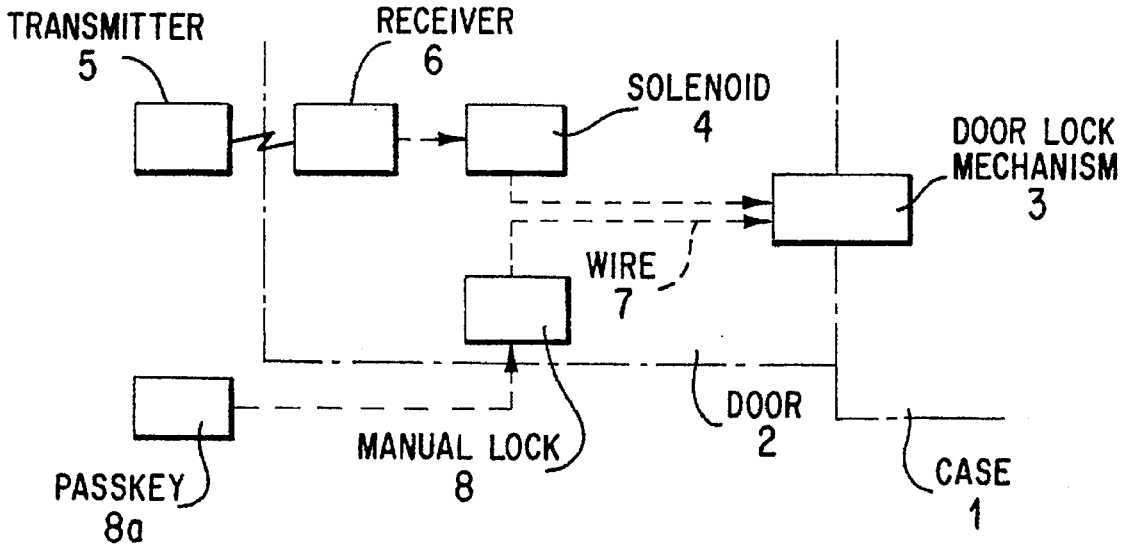

FIGS. 1(*a*) and 1(*b*) illustrates an outline of a first embodiment of the present invention. A door lock apparatus according to the present invention is disposed in a case 1 and a door 2 of a dispenser. The door locking apparatus is formed of a door lock mechanism 3 for locking the door 2 at a closed position; a solenoid 4 mounted inside the door 2 for releasing the door lock mechanism 3; a transmitter 5 for remotely controlling the solenoid 4 by sending an ID signal from the front of the dispenser; a receiver 6 mounted inside the door 2; and a manual lock 8 for manually unlocking the door. The manual lock 8 is disposed in the bottom of the door 2 while linking with the door lock mechanism 3 through a wire 7, and is operated by a passkey 8*a*. The door lock mechanism 3, the receiver 6, the manual lock 8, and the wire 7 are mounted inside the door 2, and covered with the door plate so that they may not be recognized through the front of the dispenser.

An auto-lock mechanism is adopted, as will be described later in detail, to the door lock mechanism 3, which automatically latches the door when closed. Also, the transmitter 5 and the receiver 6 are, for example, a radio transmission high frequency type. The transmitter 5 transmits an ID signal, and when the receiver 6 receives the ID signal assigned to each specific dispenser, it energizes the solenoid 4 to release the door lock mechanism 3. The solenoid 4 and the receiver 6 are connected to a power supply of the dispenser, and the transmitter 5 carries a battery therein as a power supply. The manual lock 8 is provided for releasing the door lock mechanism 3 through the wire 7 with the passkey 8*a* at the time of interruption of power supply to the dispenser.

Figure 2A:
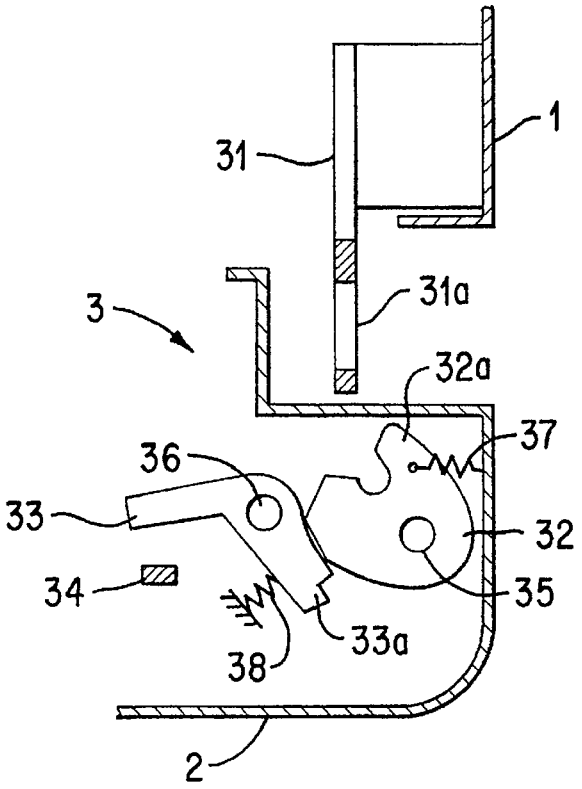
FIG. 2(*a*) is a plan view illustrating a door lock mechanism of the present invention in a released condition.
Figure 2B:
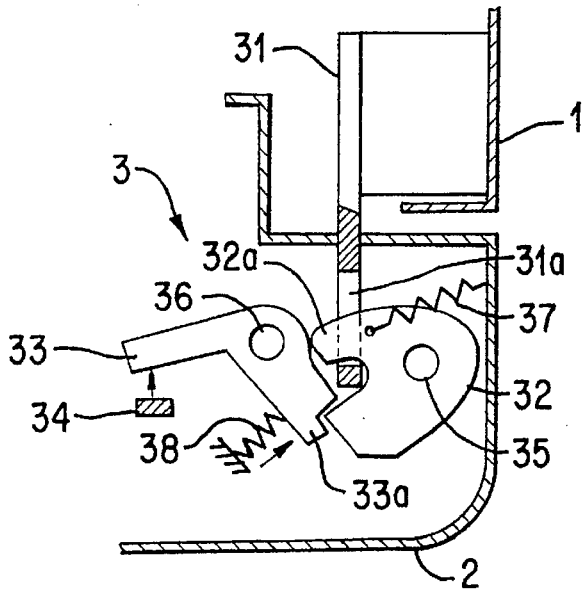

The detailed structure of the door lock mechanism 3 is shown in FIGS. 2(*a*) and 2(*b*). As shown in the drawings, the door lock mechanism 3 is formed of a lock plate 31 fixed on the front edge of the case 1 to protrude therefrom; a U-shaped cam plate 32 mounted inside the door 2 to face the lock plate 31; a latch 33 for holding the cam plate 32 at the locking and releasing positions; and a release lever 34 facing the latch 33. A reference numeral 35 designates a support pin of the cam plate 32; 36 is a support pin of the latch 33; 37 is an energizing or tension spring of the cam plate 32; and 38 is a return or compression spring of the latch 33.

When the door 2 is opened as shown in FIG. 2(*a*), the cam plate 32 is in a retreat position by being pulled by the energizing spring 37. When the door 2 is closed from this position, the tip of the lock plate 31 rotates the cam plate 32 on the way of rotation in the counter clockwise direction. A nail or pawl portion 32*a* of the cam plate 32 advances into a slit 31*a* of the lock plate 31 and couples the lock plate 31 with the cam plate 32. Also, the cam plate 32 is held on a pawl portion 33*a* of the latch 33 and is latched at the locked position as shown in FIG. 2(*b*). Thus, when the door 2 is closed, the door 2 is automatically locked.

For releasing the door lock mechanism 3 from the locked state shown in FIG. 2(*b*), the latch 33 is pushed to rotate in the clockwise direction by moving the release lever 34 in a way as described later. By this operation, the cam plate 32 is disengaged from the pawl portion 33*a* of the latch 33 and is rotated clockwise under the spring force of the energizing spring 37, so that the nail portion 32*a* of the cam plate 32 retreats from the slit 31*a* of the lock plate 31 and the lock plate 31 is released to half open the door 2. In this position, the door 2 is easily opened by hand.

Figure 3:
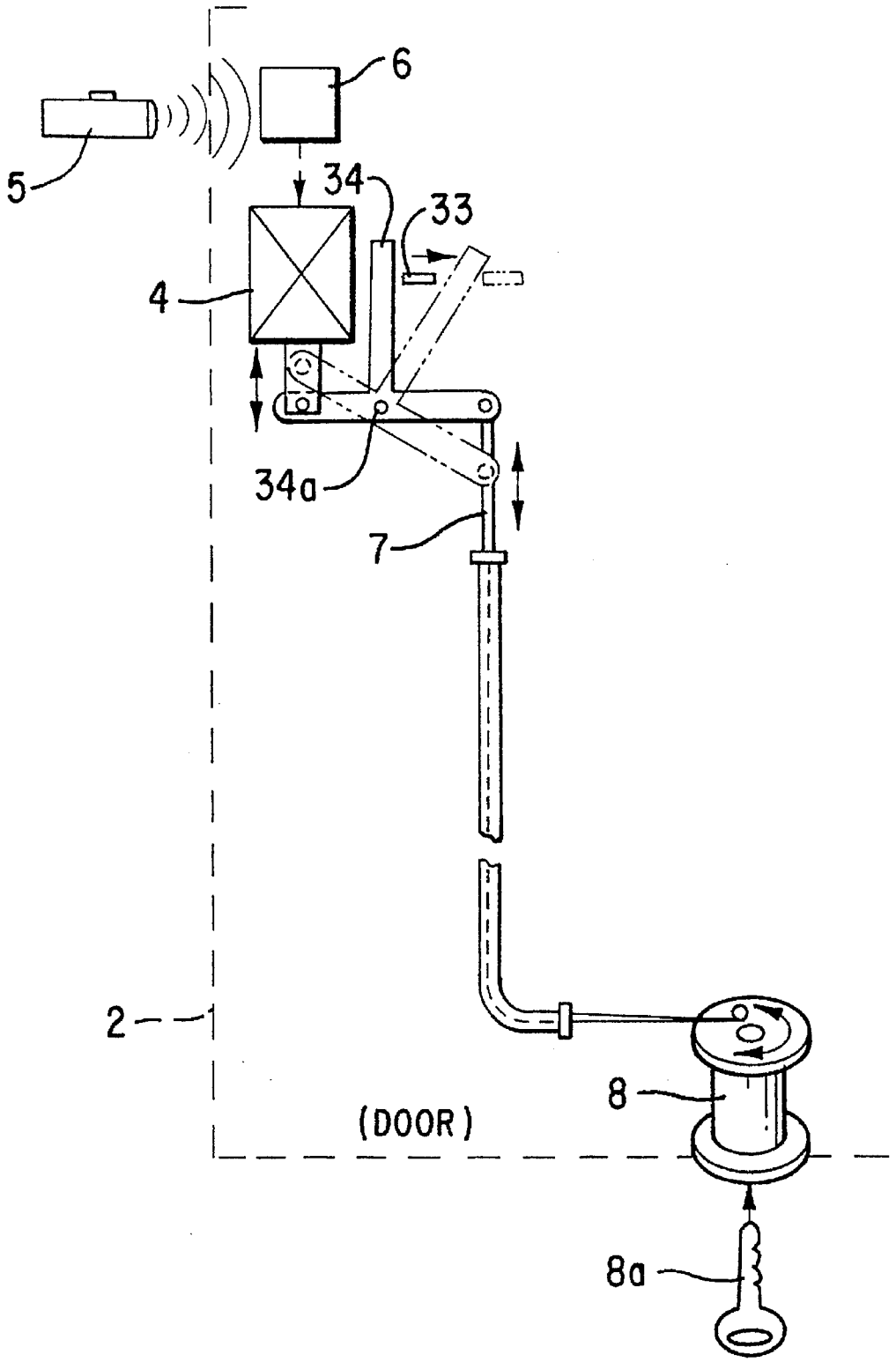
FIG. 3 is an explanatory view illustrating a release mechanism connected to the door lock mechanism of FIGS. 2(*a*) and 2(*b*)

FIG. 3 shows a release mechanism, including the release lever 34 of the door locking mechanism 3. The release lever 34 is formed of a T-shaped lever which rotates around a support rod 34*a* as a fulcrum. The solenoid 4 and the wire 7 leading out from the manual lock 8 are connected to operation ends of the T-shaped lever.

When the transmitter 5 sends the ID signal from the front of the door to the receiver 6, the receiver 6 decodes the received ID signal. When the receiver 6 judges that the received ID signal is a right one, the receiver 6 energizes the solenoid to attract the release lever 34. The attracted release lever 34 rotates the latch 33 of FIG. 2(*b*) to release the door lock mechanism 3. Alternatively, by inserting the passkey 8*a* into the manual lock 8 disposed in the bottom of the door 2 and turning the inserted passkey 8*a* in a predetermined direction, the release lever 34 is rotated through the wire 7, and the latch 33 rotates the release lever 34 to release the door lock mechanism 3, as in the solenoid 4.

Figure 4A:
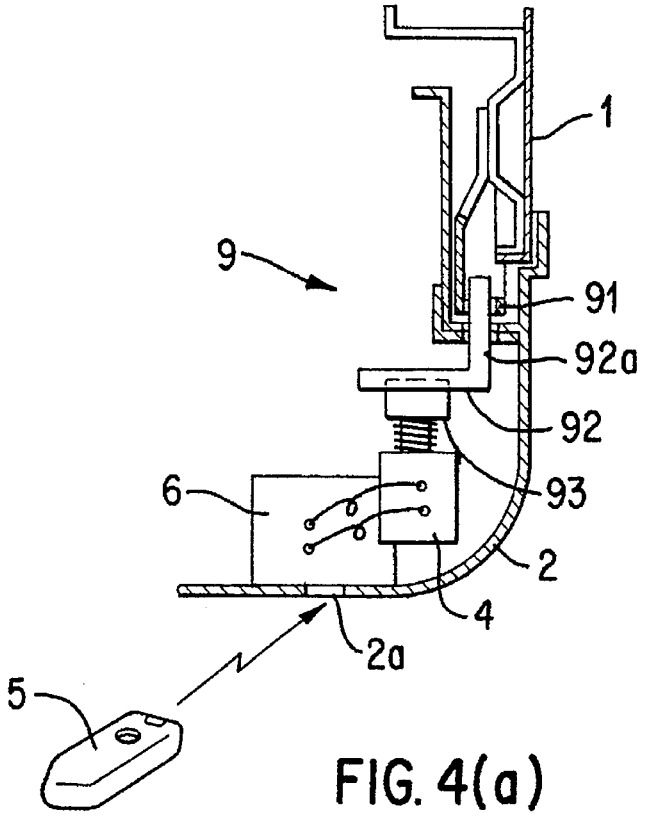
FIG. 4(*a*) is a plan view illustrating a second embodiment of the door locking apparatus for a dispenser of the invention.
Figure 4B:
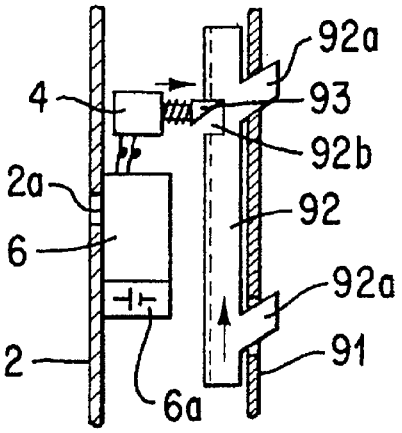
Figure 4C:
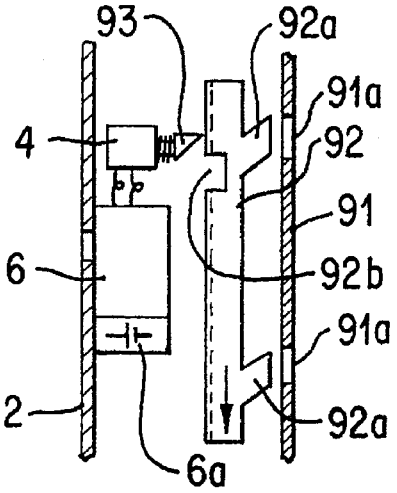

FIGS. 4(*a*) to 4(*c*) show a second embodiment of the invention. In the second embodiment, transmission of the ID signal is made by an infrared ray, wherein the transmitter 5 converts the ID signal to an infrared signal and sends the infrared signal. The receiver 6 includes an infrared detector therein, and receives the transmitted infrared signal from the transmitter 5 through an opening 2*a* of the door 2 to decode the received ID signal. In FIG. 4(*b*) and 4(*c*), a battery 6*a* is attached to the receiver 6 to supply power to the receiver 6 and the solenoid 4.

A door lock mechanism 9 for locking the door 2 at the closed position is formed of a lock plate 91 disposed on the front edge of the case 1; a cam plate 92 mounted inside the door 2 to slide vertically to engage with and disengage from the lock plate 91; and a latch 93 connected to the solenoid 4. The latch 93 is urged by a spring so that the latch 93 advances toward the cam plate 92 when the solenoid 4 is not excited. The cam plate 92 further includes a pair of coupling nails or pawls 92*a* projecting upwardly and obliquely to engage a slit 91*a* of the lock plate 91, and a trench or groove 92*b* engaging the latch 93 connected to the solenoid 4.

When the door lock mechanism 9 is released as shown in FIG. 4(*c*), the cam plate 92 descends by its weight, and the coupling nails 92*a* disengage from the slits 91*a* of the lock plate 91. In this state, the latch 93 is pushed under the spring force toward the cam plate 92 at a position away from the trench 92*b*.

When the door 2 is closed from this position as shown in FIG. 4(*b*), the coupling nails 92*a* are pushed into the slits 91*a* of the lock plate 91, and engage the lock plate 91, while the cam plate 92 is guided by the tapering planes of the slits 91*a* and the coupling nail 92*a* and slides upwardly. While the cam plate 92 is sliding upwardly, the latch 93 engages the trench 92*b* and holds the cam plate 92 at the latched position. As a result, the lock is made in the lock mechanism 9, and the door 2 is locked.

When an infrared ray carrying the ID signal is irradiated from the receiver 5 as a remote control terminal to the receiver 6 through the door 2, the receiver 6 decodes the received infrared signal. When the receiver 6 confirms that the received ID signal is a right one, the receiver 6 energizes the solenoid 4 through the power supply battery 6*a* to pull out the latch 93 from the trench 92*b* of the cam plate 92 against the spring force. As a result, the cam plate 92 slides downwardly by its weight, and the coupling nails 92*a* are disengaged from the slits 91*a* of the lock plate 91. Thus, the door lock mechanism 9 is released as shown in FIG. 4(*c*). When the door lock mechanism 9 is released, the door 2 can be opened freely by hand.

Though the power may be supplied to the solenoid 4 and the receiver 6 from the power supply of the dispenser, the battery power supply 6*a* may be mounted on the receiver 6 as shown in FIGS. 4(*a*)–4(*c*). As a result, it is possible to release the door lock mechanism 9 and to open the door 2 when the power supply service to the dispenser is interrupted.

As explained above, according to the present invention, the following effects are obtained.

(1) In the first aspect of the invention, the manual lock at the front portion of the door is eliminated, and when the door is opened, the door lock mechanism installed inside the door in order not to be seen from the front portion of the dispenser is released by the electronics or light transmission type remote control operation. Thus, it is possible to provide the dispenser with high security, which is protected from bad mischief on the lock and burglary of money and goods caused in the prior art dispenser.

(2) In the second aspect of the invention, since the manual lock is disposed at the bottom of the door, even if attempt is made to break the lock for stealing money and goods from the dispenser, it is difficult to locate the lock from the outside of the dispenser. Even if the location of the lock is realized since, the manual lock is located close to the ground or the floor, tools, such as a drill, hammer and etc. are hardly used in view of the narrow space. Thus, the door locking apparatus is superior in security against bad mischief and burglary when comparing with the conventional manual lock.

(3) In the third aspect combining the first and second aspects of the invention, the manual lock operated by a passkey is installed at a lower side of the door as releasing means for a back up of the auto-lock mechanism. Therefore, in addition to the above advantages (1) and (2), it is possible to release the door in an emergency situation, such as failure of a release mechanism of the door lock mechanism by a remote control due to breakage, power interruption and so on. Thus, there is no problem in maintenance and service.

What is claimed is:

1. A door locking apparatus for locking and unlocking a door of a dispenser and a case thereof comprising:

a door lock mechanism situated between the door and the case for latching the door at a locked position and including a lock plate fixed to one of the door and the case and having a slit therein, and engaging means fixed to the other of the door and the case, said engaging means having a cam plate vertically slidably situated in said the other of the door and the case, a pawl fixed to the cam plate to be engagable with the slit of the lock plate when the door is closed, a groove formed in the cam plate, and a latch situated adjacent to the cam plate to be engagable with the groove;

a solenoid mounted inside the door for releasing the door lock mechanism, said solenoid being connected to the latch so that when the solenoid is actuated in a condition that the door is closed, the latch is moved from the groove to allow the cam plate to move downwardly and to disengage the pawl of the cam plate from the slit of the lock plate;

a receiver mounted inside the door and connected to the solenoid; and a transmitter for sending an ID signal from an outside of the door to the receiver so that when the receiver receives the ID signal from the transmitter, the solenoid actuates the latch of the engaging means to release the lock plate of the door lock mechanism.

2. A door locking apparatus according to claim 1, wherein the door lock mechanism includes an auto-lock mechanism for automatically latching the door when closed.

3. A door locking apparatus according to claim 1, wherein said pawl fixed to the cam plate extends obliquely upwardly from the cam plate so that when the latch does not engage the groove of the cam plate, the cam plate is located in a low position and the pawl does not engage the slit of the lock plate.

4. A door locking apparatus according to claim 3, wherein a top of said pawl faces the slit when the cam plate is located in the low position so that when the door is closed, the cam plate is pushed upwardly along the slit to allow the pawl to engage the slit.

5. A door locking apparatus according to claim 4, further comprising a spring situated between the solenoid and the latch, said latch being urged toward the cam plate by the spring.

* * * * *

UNITED STATES PATENT AND TRADEMARK OFFICE

CERTIFICATE OF CORRECTION

PATENT NO. : 5,630,631
DATED : May 20, 1997
INVENTOR(S) : Shozo Iwamoto, Tetsuya Miyao, Kosaku Ito It is certified that error appears in the above-indentified patent and that said Letters Patent is hereby corrected as shown below:

In column 3, line 8, change "illustrates" to --illustrate--;

In column 5, line 37, change "since," to --, since--; and line 42, change "comparing" to --compared --.

Signed and Sealed this

Twenty-first Day of October 1997

*Attest:*

Bruce Lehman

BRUCE LEHMAN

*Attesting Officer*

*Commissioner of Patents and Trademarks*